United States Patent [19]

Kamata et al.

[11] Patent Number: 4,599,978

[45] Date of Patent: Jul. 15, 1986

[54] REED VALVE

[75] Inventors: Yoshikiyo Kamata, Hachioji; Yoshiaki Nagao, Tokyo, both of Japan

[73] Assignee: Kioritz Corporation, Tokyo, Japan

[21] Appl. No.: 707,564

[22] Filed: Mar. 4, 1985

[30] Foreign Application Priority Data

Mar. 9, 1984 [JP] Japan ..... 59-33910[U]

[51] Int. Cl.[4] ..... F02B 33/04; F02M 9/10

[52] U.S. Cl. ..... 123/73 V; 123/73 A; 137/856

[58] Field of Search ..... 123/65 V, 73 R, 73 A, 123/73 V; 137/512.1, 512.15, 855, 856

[56] References Cited

U.S. PATENT DOCUMENTS 1,494,176 5/1924 Little ..... 137/856

2,151,746 3/1939 Cody ..... 137/856 X 3,008,459 11/1961 Kaufman ..... 123/73 V 3,939,867 2/1976 Lundvik et al. ..... 137/856 X 4,475,487 10/1984 Fukuoka et al. ..... 123/73 A

*Primary Examiner*—Willis R. Wolfe, Jr.

*Attorney, Agent, or Firm*—Sheridan Neimark

[57] ABSTRACT

A reed valve includes a reed member fixed to a valve body and a stopper member which is fixed at one end thereof to the valve body together with the reed member. The stopper member is constituted by a flat plate-shaped member which is curved outwardly from the one end to its free end, and a lump member which is secured to the surface of the flat plate-shaped member on the side thereof which is remote from the reed member. The lump member has a shape which is substantially coincident with the shape of a space which is formed on the downstream side of a reed valve and does not virtually take part in the flow of intake. The lump member is disposed within the space.

3 Claims, 5 Drawing Figures

REED VALVE

BACKGROUND OF THE INVENTION

The present invention relates to a reed valve for use in an intake system communicating with a crankcase of a two-cycle internal combustion engine.

A typical conventional reed valve of the type described above includes a reed member having one end thereof fixed to a valve body and a stopper member which is fixed on the downstream side of the reed member for the purpose of limiting the extremity of opening of the reed member. The stopper member is formed from a flat plate and is fixed at one end thereof to the valve body together with the reed member. The stopper member is curved outwardly from its fixed end to its free end. In consequence, a space is present on the reverse side of the stopper member, and this space does not constitute any part of the passage for intake but serves as a stagnation space for the intake, which obstructs the smooth flow of the intake, resulting disadvantageously in a lowering of the primary compression ratio within the crankcase. Further, since the stopper member is formed from a flat plate, it is not possible to sufficiently absorb the vibration of the reed valve during operation.

SUMMARY OF THE INVENTION

It is a primary object of the present invention to overcome the above-described disadvantages of the prior art and to provide a reed valve which has a simple structure and is easily manufactured.

To this end, according to the invention, there is provided a reed valve for use in an intake system communicating with a crankcase of a two cycle internal combustion engine, which comprises: a valve body formed with a communicating bore for passing intake air into the crankcase; a reed member having one end thereof fixed to the downstream-side surface of the valve body and extending such as to close the communicating bore; and a stopper member disposed outside the reed member, wherein the stopper member has one end thereof fixed to the valve body together with the reed member at the fixed end of the reed member and is constituted by a flat plate-shaped member which is curved outwardly from the one end to the free end of the stopper member, and a lump member which is secured to the surface of the flat plateshaped member on the side thereof which is remote from the reed member, the lump member having a shape which is substantially coincident with the shape of the space which is formed on the downstream side of the reed valve and does not virtually take part in the flow of intake, and the lump member being disposed within the space.

Thus, according to the arrangement of the present invention, the stopper member is provided with the lump member which is secured to the surface of the flat plate-shaped member on the side thereof which is remote from the reed member and which has a shape which is substantially coincident with the shape of the space formed on the downstream side of the reed valve and does not virtually take part in the flow of intake and which lump member is disposed within the space. There is, therefore, no intake air stagnation space on the downstream side of the reed valve, that is, within the crankcase, which fact advantageously increases the intake efficiency and the primary compression ratio within the crankcase. In consequence, the engine output is increased, and the idle running of the engine is stabilized. In addition, the starting and acceleration performances of the engine are improved. Moreover, it is advantageously possible to absorb the vibration of the reed valve, so that its operation is stabilized and the noise level is favorably lowered. Furthermore, the reed valve has a conveniently simple structure and is easily manufactured.

The above and other objects, features and advantages of the present invention will become clear from the following description of the preferred embodiment thereof, taken in conjunction with the accompanying drawings.

DESCRIPTION OF THE PREFERRED EMBODIMENT

The present invention will be described hereinunder through one embodiment with reference to the accompanying drawings.

Figure 1:
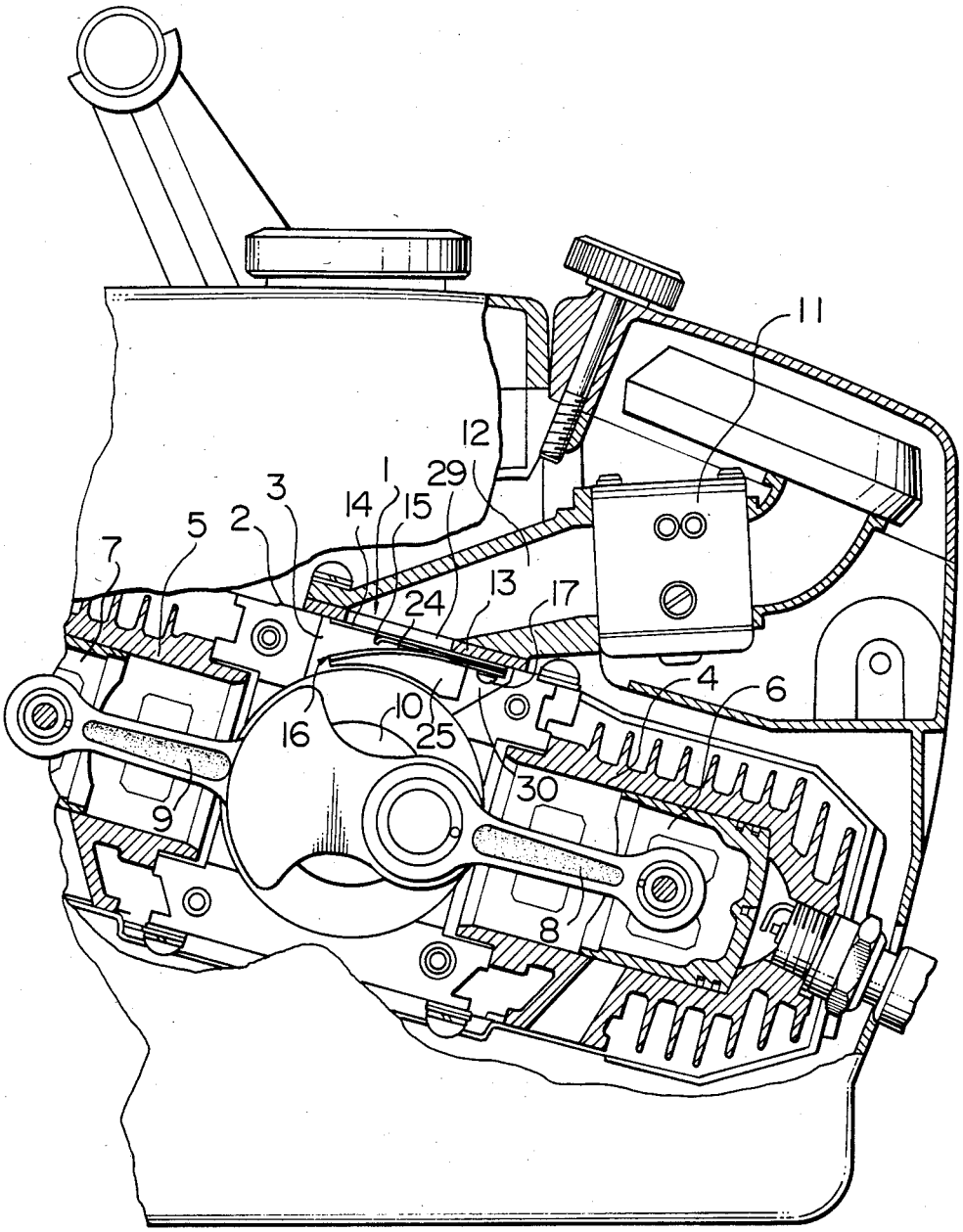
FIG. 1 is a sectional view of an essential portion of a horizontally opposed two-cylinder two-cycle internal combustion engine which incorporates the reed valve according to the present invention.

Referring first to FIG. 1 which shows an essential portion of a horizontally opposed two-cylinder two-cycle internal combustion engine which incorporates a reed valve 1 according to the present invention, this engine is mounted on a portable chain saw. The engine includes an engine body 2 which has a crankcase 3 formed in its center. A pair of cylinders 4, 5 are disposed on both sides of the crankcase 3 in opposed relation to each other. Pistons 6, 7 are reciprocatably provided in the respective cylinders 4, 5. The engine further includes connecting rods 8, 9. One end of the connecting rod 8 is pivotally connected to the piston 6, while one end of the connecting rod 9 is pivotally connected to the piston 7. In addition, a rotating output shaft 10 is rotatably provided inside the crankcase 3. To the output shaft 10 are pivotally connected the respective other ends of the connecting rods 8, 9 at eccentric positions which are 180° out of phase from each other. The crankcase 3 is supplied with air-fuel mixture from a carburetor 11 through a duct 12 and the reed valve 1.

The reed valve 1 has a flat plate-shaped valve body 13 secured to the engine body 2. The valve body 13 has a pair of communicating bores 29 formed therein side by side for providing communication between the respective insides of the duct 12 and the crankcase 3. The reed valve 1 further has a main reed member 14, an auxiliary reed member 15 and a stopper member 16 which are overlaid one upon another in the mentioned order and are fixed together by pins 17 to the surface of the valve body 13 on the side thereof which is closer to the crankcase 3, that is, the downstream-side surface of the valve body 13.

Figure 2:
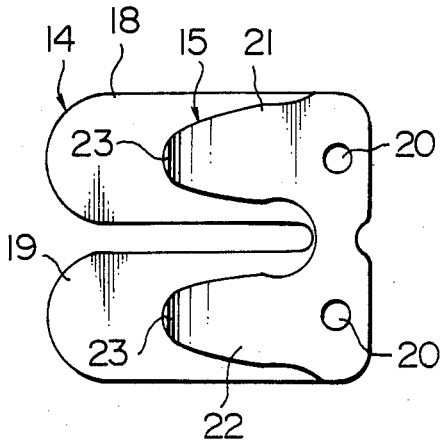
FIG. 2 is a plan view of reed members employed in the reed valve shown in FIG. 1.

The main reed member 14, as shown in FIG. 2, has a pair of reed pieces 18, 19 which extend in parallel to each other. The reed pieces 18, 19 are integrally connected together at the end portion of the main reed member 14 at which are formed bores 20 for receiving the respective pins 17. The reed pieces 18, 19 are arranged such that their intermediate portions are employed to close the respective communicating bores 29 formed in the valve body 13.

Figure 3:
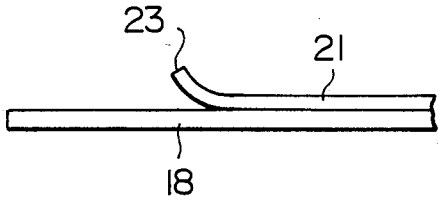
FIG. 3 is a partially cutaway side elevational view of the reed members shown in FIG. 2.

The auxiliary reed member 15 has reed pieces 21, 22 which are overlaid on the respective reed pieces 18, 19 of the main reed member 14. The reed pieces 21, 22 are integrally connected together at the end portion of the auxiliary reed member 15 at which are formed the bores 20 for receiving the respective pins 17. The reed pieces 21, 22 of the auxiliary reed member 15 are smaller in length than the reed pieces 18, 19 of the main reed member 14. In addition, each of the reed pieces 21, 22 is gradually decreased in width toward its free end 23. By virtue of this arrangement, it is possible to increase the natural frequency, that is, the point of resonance, of the reed valve without lowering its performance at low speeds, so that it is possible to increase the speed and the acceleration performance of the engine. Further, as shown in FIG. 3, the respective free ends 23 of the reed pieces 21, 22 are bent outwardly, that is, in a direction in which they are away from the corresponding reed pieces 18, 19 of the main reed member 14. The angle of this bending is preferably larger than 45 degrees. Thus, it is possible to greatly extend the lifetime of the reed valve.

Figure 4:
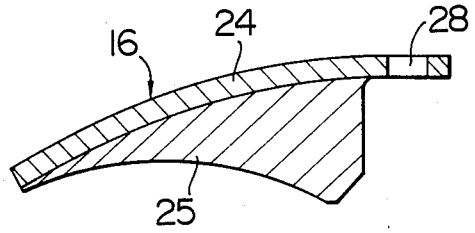
FIG. 4 is a sectional side elevational view of a stopper member employed in the reed valve shown in FIG. 1.
Figure 5:
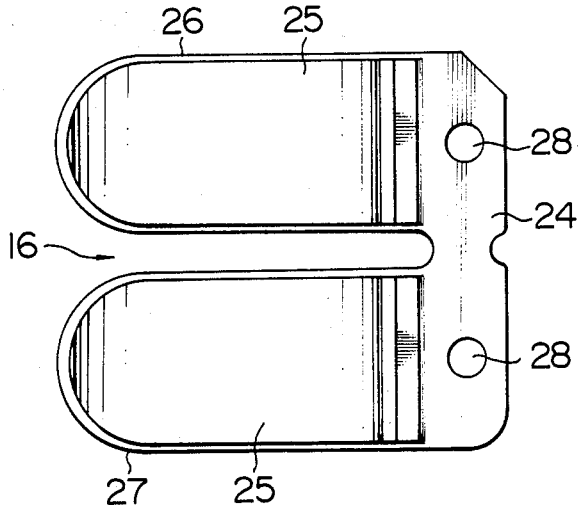
FIG. 5 is a plan view of the stopper member shown in FIG. 4.

The stopper member 16 is, as shown in FIGS. 4 and 5, constituted by a flat plate-shaped member 24 and lump members 25. The flat plate-shaped member 24 has a planar configuration of a size which is substantially equal to that of the planar configuration of the main reed member 14. The flat plate-shaped member 24 has a pair of stopper portions 26 and 27. The stopper portions 26, 27 are integrally connected together at their respective end portions at which are formed bores 28 for receiving the respective pins 17. Further, the stopper portions 26, 27 are disposed immediately below the corresponding reed pieces 18, 21 and 19, 22. The stopper portions 26, 27 are curved downwardly from their fixed ends to their free ends.

The lump members 25 are formed of a rubber or a plastic material which has heat resistance and is not easily corroded by such a substance as gasoline and a lubricating oil. The lump members 25 are bonded to the respective surfaces of the stopper portions 26, 27 on the side thereof which is remote from the reed members 14, 15, that is, on the respective lower surfaces of the stopper members 26, 27. The lump members 25 extend from the respective free ends of the stopper portions 26, 27 to portions thereof close to the corresponding bores 28 formed at the respective fixed ends of the stopper portions 26, 27. As shown in FIG. 3, the entirety of each lump members 25 is essentially integral with stopper members 26, 27. The thickness of the lump members 25 is, as shown in FIG. 4, gradually increased toward the fixed ends. Thus, the lump members 25 are formed in a shape which is substantially coincident with the shape of a space 30 which is formed on the downstream side of the reed valve 1 and does not virtually take part in the flow of intake, and are disposed in such a manner as to fill the space 30 to the maximum extent.

Although the invention has been described through specific terms, it is to be noted here that the described embodiment is not exclusive and various changes and modifications may be imparted thereto without departing from the scope of the invention which is limited solely by the appended claims.

What is claimed is:

1. A reed valve for use in an intake system communicating with a crankcase of a two-cycle internal combustion engine, which comprises:

a valve body formed with a communicating bore for passing air-fuel, from a carburetor, downstream into said crankcase;

a reed member having one end thereof fixed to a downstream-side surface of said valve body and extending such as to close said communicating bore; said reed member having an upstream and a downstream side; and a stopper member disposed downstream from said reed member, wherein said stopper member has one end thereof fixed to said valve body together with said reed member at the fixed end of said reed member and is constituted by a flat plate-shaped member which is curved downstream from said reed member from said one end to its free end, said flat-plate shaped member having one surface facing said reed member and an opposing surface remote from said reed member and a lump member which is secured to the surface of said flat plate-shaped member which is remote from said reed member, said lump member extending from said free end to about said fixed end, said lump member gradually increasing in thickness from said free end to said fixed end, and having a shape which is substantially coincident with a space which is formed on the downstream side of said reed valve and does not virtually take part in the flow of intake, said lump member being disposed within said space.

2. A reed valve according to claim 1, wherein said lump member is formed of a rubber or a plastic material.

3. A reed value according to claim 1 wherein the entirety of said lump member is essentially integral with said plate-shaped member.

* * * * *